US009462863B1

(12) United States Patent
Augenstein

(10) Patent No.: US 9,462,863 B1
(45) Date of Patent: Oct. 11, 2016

(54) ROLLING BAG FOR ASCENDING AND DESCENDING A STAIRCASE

(71) Applicant: David Augenstein, New Albany, OH (US)

(72) Inventor: David Augenstein, New Albany, OH (US)

( * ) Notice: Subject to any disclaimer, the term of this patent is extended or adjusted under 35 U.S.C. 154(b) by 238 days.

(21) Appl. No.: 14/321,313

(22) Filed: Jul. 1, 2014

(51) Int. Cl.
*A45C 5/14* (2006.01)

(52) U.S. Cl.
CPC ..... *A45C 5/14* (2013.01)

(58) Field of Classification Search
CPC ..... A45C 5/14
See application file for complete search history.

(56) References Cited

U.S. PATENT DOCUMENTS

| | | | | |
|---|---|---|---|---|
| 2,597,532 | A * | 5/1952 | Richardson | B62B 5/02 280/5.22 |
| 3,420,540 | A * | 1/1969 | William | B62B 5/02 280/47.26 |
| 4,932,677 | A * | 6/1990 | Shustack | A45C 5/14 280/28.5 |
| 5,579,877 | A | 12/1996 | Homayoon | |
| 6,938,740 | B2 * | 9/2005 | Gandy | A45C 5/14 190/115 |
| 7,980,337 | B2 * | 7/2011 | A/L Lynkaran | A45C 5/14 180/8.1 |
| 8,333,389 | B2 | 12/2012 | Rembos | |
| 8,439,371 | B1 * | 5/2013 | Vazquez | B62B 5/02 180/8.2 |
| 8,540,039 | B1 * | 9/2013 | Hsiao | A45C 5/04 180/9.1 |
| 8,596,433 | B2 | 12/2013 | Tauro | |
| 2006/0213735 | A1 | 9/2006 | Weinstein | |
| 2007/0215424 | A1 | 9/2007 | Mittleman | |
| 2008/0230339 | A1 * | 9/2008 | Pereira | A45C 5/03 190/18 A |
| 2010/0018821 | A1 | 1/2010 | Minaker | |

FOREIGN PATENT DOCUMENTS

| | | |
|---|---|---|
| EP | 2153743 | 2/2010 |
| WO | WO2007100771 | 9/2007 |
| WO | WO2008115095 | 9/2008 |
| WO | WO2008129577 | 10/2008 |

* cited by examiner

*Primary Examiner* — Tri Mai
(74) *Attorney, Agent, or Firm* — Goldstein Law Offices, P.C.

(57) ABSTRACT

A rolling bag adaptable for ascending and descending a staircase safely as well as for level and incline rolling. A handle selectively tilts to an angle that provides maximum leverage for ascent and descent of the bag on a staircase. The handle has a locking device that sets the desired tilt angle. The rolling bag has a recessed conveyor at the rear that has a track that selectively loosens when adapting to a staircase by increasing distance the conveyor rolls, the track conforming to a tread and a riser of a staircase. The conveyor has an offset device that selectively adjusts the track tension, the offset device coupled to handle so that when the handle tilts the track tension is loosened.

14 Claims, 6 Drawing Sheets

ROLLING BAG FOR ASCENDING AND DESCENDING A STAIRCASE

TECHNICAL FIELD

The present disclosure relates generally to luggage. More particularly, the present disclosure relates to a rolling bag for ascending and descending a staircase.

BACKGROUND

Luggage with extendable handles and wheels are very popular for travelers. The luggage rolls smoothly over the flat floor, onto elevators, people movers, across parking lots and any surface that is flat. Rolling bags even manage low curbs, albeit with the user having to exert some strength pulling the bag up over the curb. Rolling bags do well on inclines such as jetway ramps, handicap ramps and curb cutouts.

However, rolling bags are not well adapted to stairs. Generally, the user collapses the extended handle and picks up the bag by the handle grip and carries it up and down the stairs, bearing the full weight of the bag and its contents.

If the user tries to roll the bag up or down the stairs, the results are disastrous and potentially dangerous. Going down stairs, dragging the luggage behind is risky because the bag can fall forward in a free fall, knocking the user down, pulling the user forward or causing the user to lose balance. Going up stairs, the extended handle is not the correct length for proper load distribution and the angle of the handle is awkward. Other than finding an elevator, the solution is to carry the bag by the grip handle up and down the stairs.

While this may be suitable for the particular purpose employed, this would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a rolling bag that adapts to most transportation situations. Accordingly, the present disclosure provides a rolling bag adaptable for level and incline rolling and for ascending and descending a staircase safely.

Another aspect of an example embodiment in the present disclosure is to provide a rolling bag having a handle for adapting when ascending and descending a staircase. Accordingly, the present disclosure provides a rolling bag handle that is selectively tilts to an angle that provides maximum leverage for ascent and control for descent of the bag on a staircase.

A further aspect of an example embodiment in the present disclosure is to provide a rolling bag that rolls over a staircase. Accordingly, the present disclosure provides a rolling bag with a recessed conveyor that has a track that selectively loosens when adapting to a staircase by increasing distance the conveyor rolls when traversing a staircase.

Yet a further aspect of an example embodiment in the present disclosure is to provide a rolling bag that adapts to a tread and a riser of a staircase. Accordingly, the present disclosure provides a rolling bag with a track that selectively loosens when adapting to a staircase so that the track conforms to a tread and a riser of a staircase.

Accordingly, the present disclosure describes rolling bag adaptable for ascending and descending a staircase safely as well as for level and incline rolling. A handle selectively tilts to an angle that provides maximum leverage for ascent and descent of the bag on a staircase. The handle has a locking device that sets the desired tilt angle. The rolling bag has a recessed conveyor at the rear that has a track that selectively loosens when adapting to a staircase by increasing distance the conveyor rolls, the track conforming to a tread and a riser of a staircase. The conveyor has an offset device that selectively adjusts the track tension, the offset device coupled to handle so that when the handle tilts the track tension is loosened.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
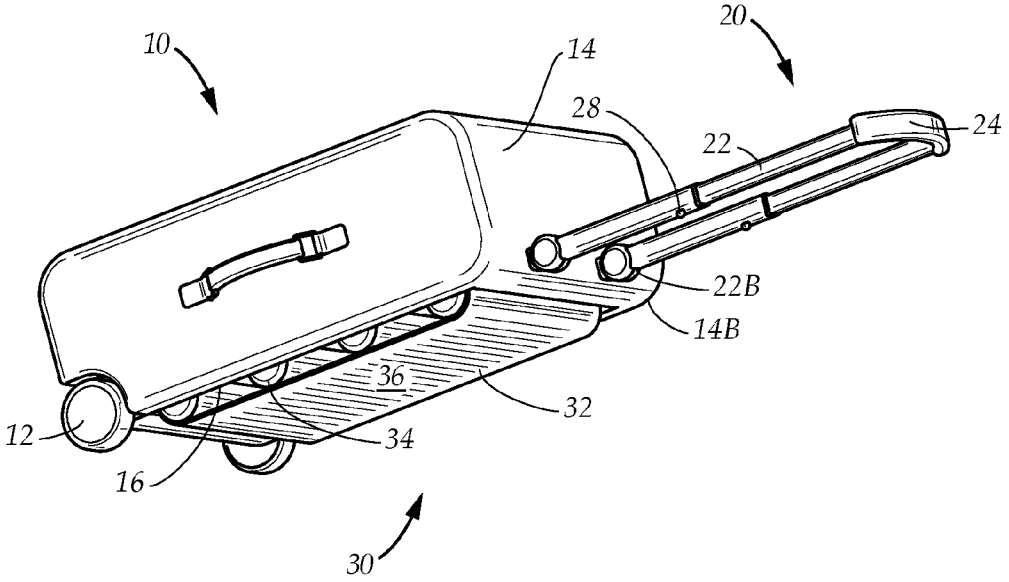
FIG. 1 is a perspective view an example embodiment of a rolling bag for ascending and descending a staircase.

FIG. 1 illustrates a rolling bag 10 configured for ascending and descending a staircase as well as rolling on a level or incline surface. The rolling bag 10 provides control on the staircase descent and leverage on the staircase ascent.

The rolling bag 10 has a telescoping, tilting handle 20 that tilts into a plurality of angles. The tilting handle 20 has a pair of telescoping supports 22, and a hand grip 24, a pair of vertical supports 22, a support 22 on each side of the hand grip 24. The supports 22 each having a plurality of vertical sections 26 that slide telescopically when the handle 20 is extended and retracted. Each support has a bottom vertical section 22B that has a pivot 26. On at least one support 22 is a pin 28 that selectively locks the supports into a tilted position and selectively releases the supports from the tilted position to a substantially vertical position.

The rolling bag 10 has a main compartment 14 with a back 14B having a recess 16. In the recess 16 is a conveyor belt 30 with a continuous track 32 driven by a plurality of rollers 34. The continuous track 32 has an outer tread 36 configured for traction.

The rolling bag 10 has a plurality of wheels 14 at the compartment bottom configured for rolling along on the level or on the incline. Wheels on rolling bags are well-known to those of ordinary skill and the number and the configuration of the wheels are not within the scope of the present disclosure.

Figure 2:
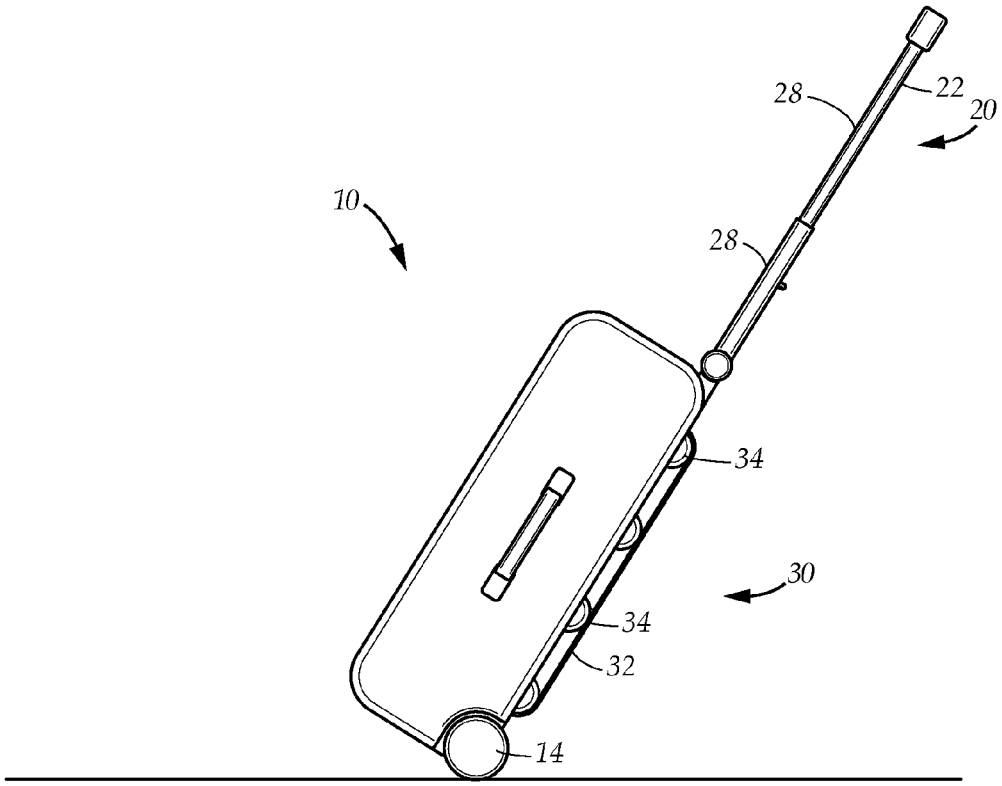
FIG. 2 is a side elevational view of an example embodiment of the rolling bag in a position for rolling on a level surface.

FIG. 2 shows the rolling bag 10 configured for rolling along on the level or on the incline. The conveyor belt 30 and the tilting handle 20 are aligned in a substantially straight line when the tilting handle 20 is fully extended and vertical. The continuous track 32 is taut over the rollers 34, preventing the track 34 from sagging and interfering with the rolling wheels. When the tilting handle 20 retracts for stowing, the continuous track 32 is taut, preventing the track from tangling with other objects in a stowage area.

Figure 5A:
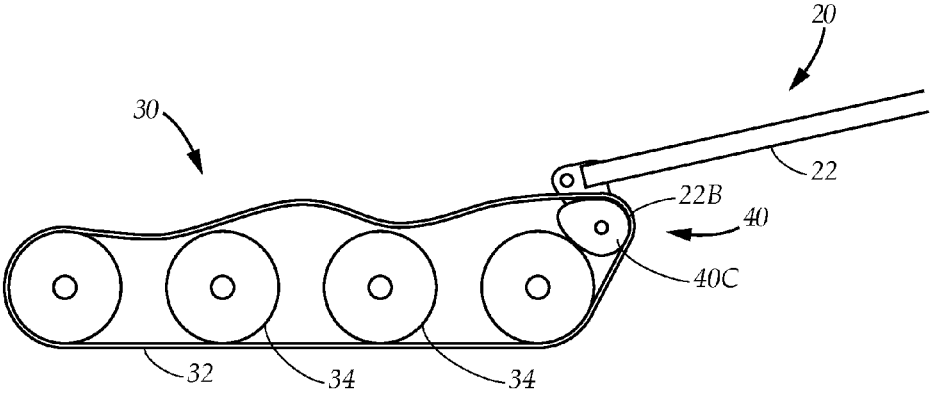
FIG. 5A is a side elevational view of an example embodiment of a conveyor of the rolling bag having a cam and a track in a slack position.
Figure 5B:
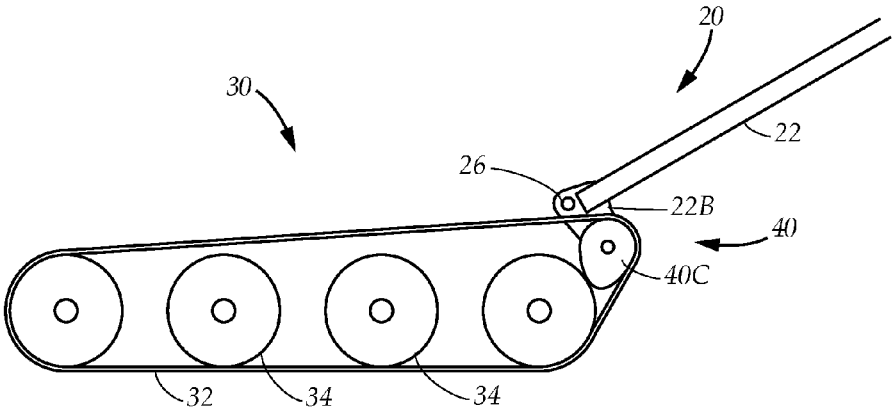
FIG. 5B, similar to FIG. 5A, is a side elevational view of an example embodiment of the conveyor of the rolling bag having the cam in a tension position for ascending and descending a staircase.
Figure 5C:
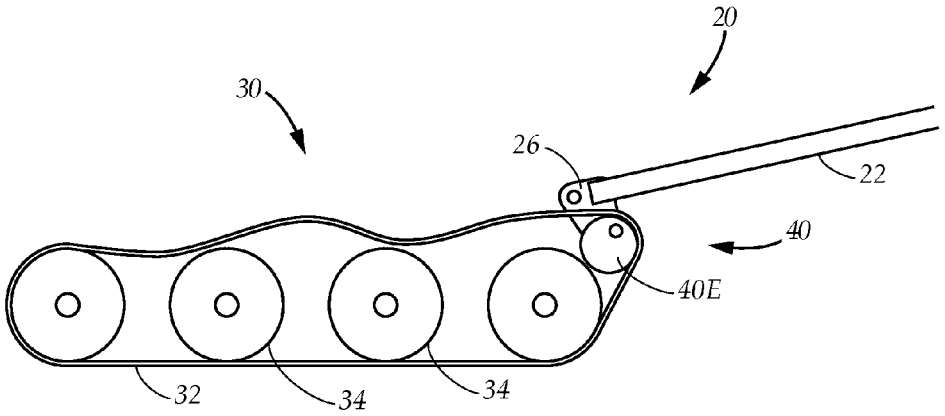
FIG. 5C, similar to FIG. 5A, is a side elevational view of an example embodiment of the conveyor of the rolling bag having an offset roller and a track in a slack position.
Figure 5D:
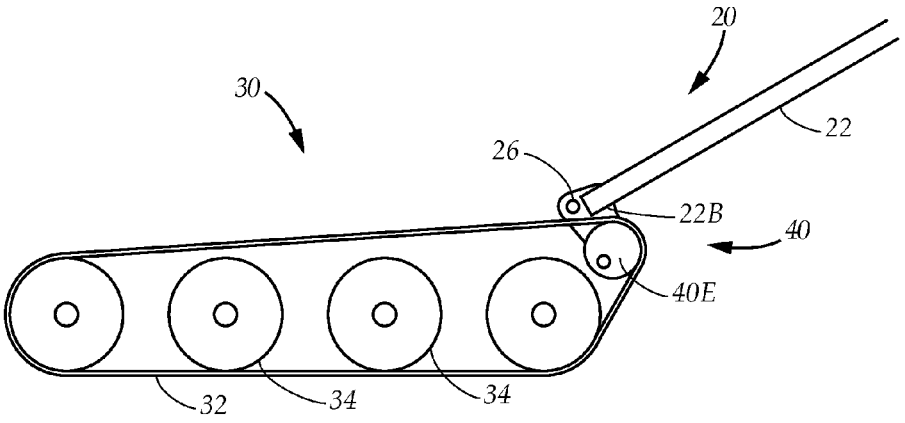
FIG. 5D, similar to FIG. 5B, is a side elevational view of an example embodiment of the conveyor of the rolling bag having the offset roller in a tension position for ascending and descending a staircase.

FIGS. 5A-5D illustrate the conveyor belt 30. Within the continuous belt 32 is an offset device 40 coupled to the support bottom 22B of the tilting handle 20. The offset device 40 selectively engages the rollers 34 of the conveyor belt 30 thereby increasing the tension of the track 32, as shown in FIGS. 5B and 5D, said track is taut for stowage when the tilting handle 20 is retracted and for rolling when the tilting handle is substantially upright. When the offset device 40 selectively decreases the tension of the track 32 by disengaging the rollers 34 when the tilting handle 20 tilts, slack is created in the track 32 operative for ascending and descending the staircase. The slack track 32 conforms to a riser and a tread of a staircase, increasing the distance the track travels, allowing the rollers 34 to roll up the riser and transverse the stair tread.

In FIG. 5A and FIG. 5B, in one example embodiment, the offset device 40 is a cam 40C; in FIG. 5C and FIG. 5D, in a further example embodiment, the offset device 40 is an eccentric roller 40E.

In one example embodiment, the pivot 26 has a ratchet configured for locking the vertical supports 22 of the handle 20 in place when a desired tilt is achieved. The ratchet is at the bottom 22B of the vertical supports engages the offset device 40.

Figure 3:
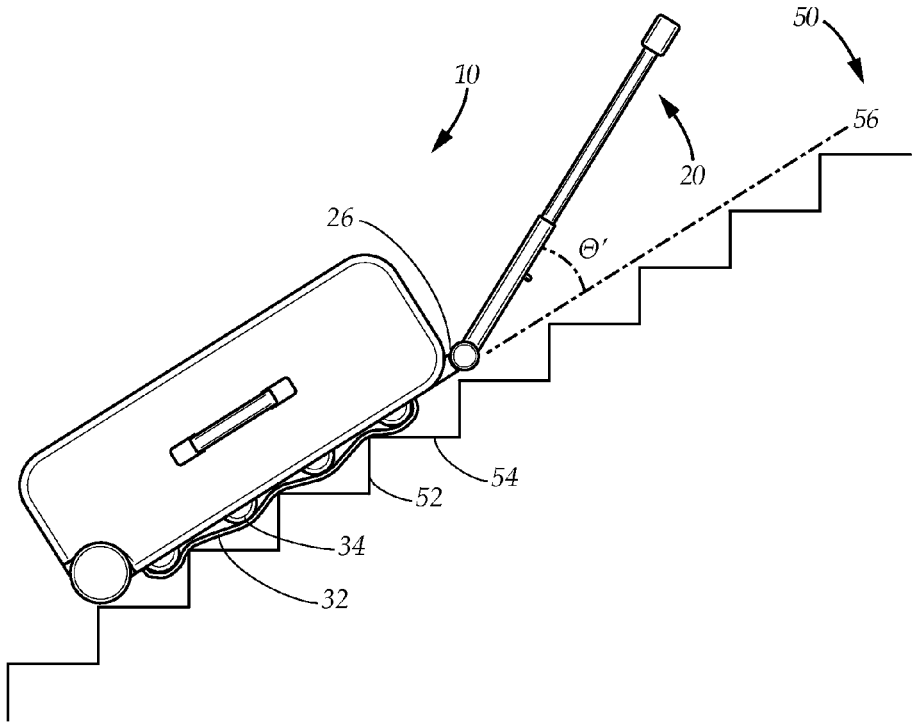
FIG. 3 is a side elevational view of an example embodiment of the rolling bag in a position for ascending a staircase.

FIG. 3 demonstrates the rolling bag 10 ascending the staircase 50. The staircase has risers 52 and treads 54 at an incline known as a pitch 56 which is the line of inclination from horizontal. The slack track 32 conforms to the risers 52 and treads 54 allowing the rollers 34 to traverse the staircase 50.

The tilting handle tilts into a plurality of angles, a first angle, θ' about ten (10) to thirty (30) degrees, preferably ten (10) degrees, upwards as measured from the pitch 56 or from an imaginary line extending from the continuous track when ascending the staircase.

Figure 4:
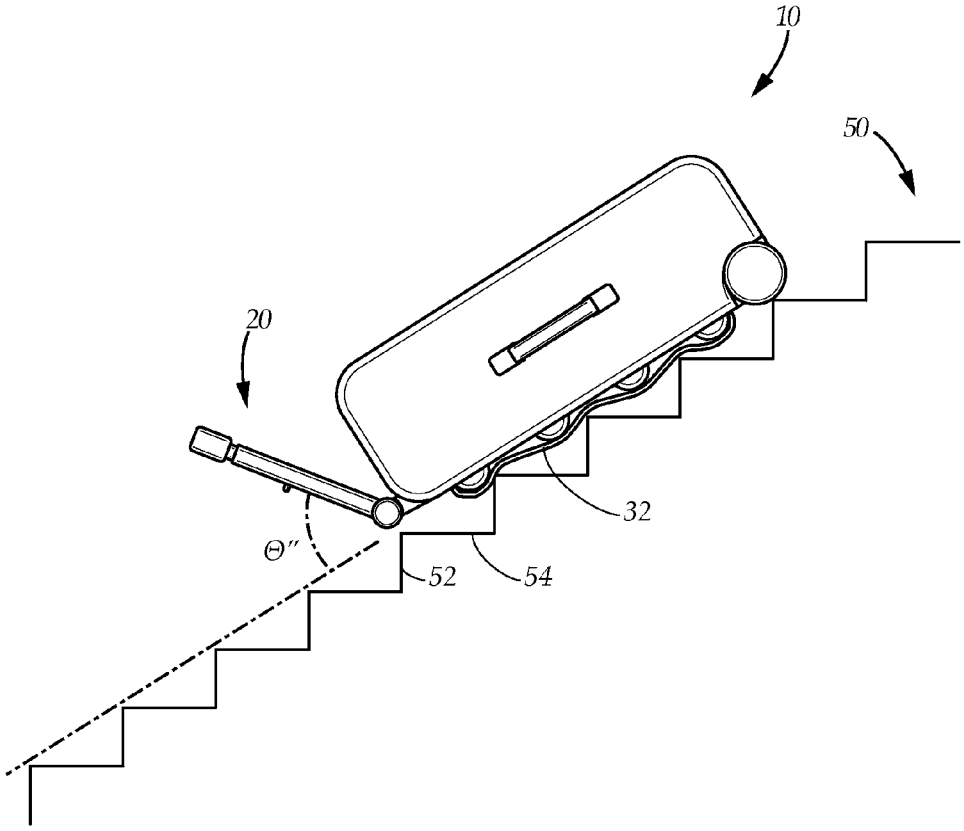
FIG. 4 is a side elevational view of an example embodiment of the rolling bag in a position for descending a staircase.

FIG. 4 demonstrates the rolling bag 10 descending the staircase 50. The slack track 32 conforms to the risers 52 and treads 54 as explained hereinabove. The tilting handle 20 tilts into a second angle, 8" about forty (40) to sixty (60) degrees, preferably fifty (50) degrees upwards as measured from the pitch 56 or from the imaginary line extending from the continuous track 32 when descending the staircase. The tilting handle 20 retracts and extends to a plurality of lengths. As illustrated, the tilting handle 20 is at a short length for descent, allowing more control over the bag 20.

The angle for descent is determined by subtracting the angle of the staircase, which varies from thirty (30) degrees to forty (42) from the vertical line formed by a user at ninety (90) degrees.

FIG. 2 shows a third angle θ for rolling the rolling bag, the tilting handle 20 forming a straight line or 180 degrees with the imaginary line extending from the continuous track.

As explained hereinabove, the tilting handle selectively extends and retracts to an optimal length for the situation, the handle supports substantially retracting into the rolling bag for stowage. In one example embodiment, each section 28 of the supports 22 tilt independently of an adjacent vertical section, the tilting handle adaptable to many situations.

Referring to FIG. 1, a method for manufacturing the rolling bag 10 is illustrated. The tilting handle 20 couples to the main compartment 14 of the rolling bag 10, the handle configured for tilting into a plurality of angles. The conveyor belt 30 couples to the recess 16 in the back 14B of the main compartment 14B, the conveyor belt 30 having the continuous track 32 and the plurality of rollers 34 driving the track 32.

It is understood by those of ordinary skill that the step of coupling the conveyor belt to the recess in the back of the main compartment can be performed before the tilting handle is coupled to the main compartment.

The offset device 40 of the conveyor belt 30 shown in FIGS. 5A-5D couples to the tilting handle 20 at the bottom 22B of the handle support 22, the offset device 40 selectively engaging the rollers 34 of the conveyor belt 30 thereby increasing the tension of the track 32, the track being taut and selectively decreasing the tension of the track 32 when the tilting handle 20 is tilted for ascending and descending the staircase.

It is understood that the term bag refers to refers to luggage and baggage in general and can be, for example, but not limited to, a suitcase, a backpack, a duffel, a gym bag, a trunk, a garment bag, a valise and a kit bag.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a rolling bag for ascending and descending a staircase. The disclosure is illustrated by example in the drawing figures, and throughout the written description. It should be understood that numerous variations are possible, while adhering to the inventive concept. Such variations are contemplated as being a part of the present disclosure.

What is claimed is:

1. A rolling bag configured for ascending and descending a staircase, comprising:

a tilting handle, said handle configured for tilting into a plurality of angles, a first angle configured for ascending a staircase, a second angle for descending the staircase and a third angle for rolling on a plurality of bottom wheels, said handle retracting and extending to a plurality of lengths, a first length for ascending the staircase, a second length for descending the staircase and a third length for rolling;

a conveyor belt, having a continuous track, said track driven by a plurality of rollers; and an offset device, said offset device coupled to the bottom of the tilting handle, the offset device selectively engaging the rollers of the conveyor belt when the tilting handle is the third angle for rolling thereby increasing the tension of said track, said track being taut, the offset device selectively disengaging the rollers of the conveyor belt thereby decreasing the tension of the track when the tilting handle is tilted in the first angle configured for ascending the staircase and the second angle configured for descending the staircase.

2. The rolling bag as described in claim 1, wherein the conveyor belt is set into a recess in a back of the rolling bag.

3. The rolling bag as described in claim 2, wherein the continuous track has an outer tread configured for traction.

4. The rolling bag as described in claim 3, wherein the offset device is a cam.

5. The rolling bag as described in claim 3, wherein the offset device is an eccentric roller.

6. The rolling bag as described in claim 1, wherein the tilting handle has a pair of telescoping supports, and a hand grip, a support on each side of the hand grip, the supports each having a plurality of vertical sections.

7. The rolling bag as described in claim 6, wherein the vertical supports of the telescoping handle each have a bottom having a pivot.

8. The rolling bag as described in claim 7, wherein the pivot has a ratchet, the ratchet configured for locking the vertical supports in place when a desired tilt is achieved.

9. The rolling bag as described in claim 7, wherein the telescoping handle supports have a pin that selectively locks the supports into a tilted position and selectively releases the supports from the tilted position to a substantially vertical position.

10. The rolling bag as described in claim 9, wherein the handle supports have a bottom section and the ratchet of the bottom section engages the offset device.

11. The rolling bag as described in claim 1, wherein the conveyor belt and the tilting handle are aligned in a substantially straight line when the tilting handle is fully extended and vertical.

12. The rolling bag as described in claim 11, wherein the tilting handle tilts about ten degrees upwards from the continuous track when ascending the staircase.

13. The rolling bag as described in claim 12, wherein the tilting handle tilts about fifty degrees upwards from the continuous track when descending the staircase.

14. A method for manufacturing a rolling bag configured for ascending and descending a staircase, comprising:

coupling a tilting handle to a main compartment of a rolling bag, said handle configured for tilting into a plurality of angles, a first angle configured for ascending a staircase, a second angle for descending the staircase and a third angle for rolling, said handle telescopically retracting and extending to a plurality of lengths, a first length for ascending the staircase, a second length for descending the staircase and a third length for rolling;

coupling a conveyor belt to a recess in a back of the main compartment, said conveyor belt having a continuous track and a plurality of rollers driving said track; and coupling an offset device to the tilting handle at a bottom of the handle, the offset device selectively engaging the rollers of the conveyor belt thereby increasing the tension of said track, said track being taut and selectively decreasing the tension of the track when the tilting handle is tilted in the first angle configured for ascending the staircase and the second angle is tilted for descending the staircase.

* * * * *